US006914082B2

(12) United States Patent
Zhang et al.

(10) Patent No.: US 6,914,082 B2
(45) Date of Patent: Jul. 5, 2005

(54) SLURRY BUBBLE REACTOR OPERATED IN WELL-MIXED GAS FLOW REGIME

(75) Inventors: Jianping Zhang, Ponca City, OK (US); Rafael L. Espinoza, Ponca City, OK (US); Sergio Mohedas, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 19 days.

(21) Appl. No.: 10/023,258

(22) Filed: Dec. 14, 2001

(65) Prior Publication Data

US 2003/0114543 A1 Jun. 19, 2003

(51) Int. Cl.[7] ..... C07C 27/00
(52) U.S. Cl. ..... 518/700; 518/706; 518/715
(58) Field of Search ..... 518/700, 706, 518/715

(56) References Cited

U.S. PATENT DOCUMENTS

| | | | | | |
|---|---|---|---|---|---|
| 5,116,879 | A | * | 5/1992 | Eri et al. | 518/716 |
| 5,252,613 | A | | 10/1993 | Chang et al. | 518/700 |
| 5,348,982 | A | | 9/1994 | Herbolzheimer et al. | 518/700 |
| 5,382,748 | A | | 1/1995 | Behrmann et al. | 585/899 |
| 5,827,902 | A | | 10/1998 | Maretto et al. | 518/706 |
| 5,961,933 | A | | 10/1999 | Casanave et al. | 422/211 |
| 6,060,524 | A | | 5/2000 | Casanave et al. | 518/706 |
| 6,156,809 | A | | 12/2000 | Clark et al. | 518/719 |
| 6,169,120 | B1 | | 1/2001 | Beer | 518/715 |
| 6,403,660 | B1 | | 6/2002 | Espinoza et al. | 518/700 |
| 2003/0096881 | A1 | | 5/2003 | Minkkinen et al. | 518/728 |
| 2003/0109590 | A1 | * | 6/2003 | Schweitzer et al. | 518/715 |

FOREIGN PATENT DOCUMENTS

| | | | |
|---|---|---|---|
| WO | WO01/00595 | 4/2001 | C07D/249/12 |
| WO | 01/72928 | * 10/2001 | |

OTHER PUBLICATIONS

Article entitled: "*Non–isobaric bubble columns with variable gas velocity*," by Wolf–Dieter Deckwer, Institute for Technische Chemier, Berlin, Chemical Engineering Science, vol. 31, pp. 309–317, 1976.

Article entitled: "*Analysis of the design of bubble–column reactors for Fischer–Tropsch synthesis*," by David Stern et al., American Chemical Society, pp. 1213–1219, 1985.

Article entitled: "*Bubble column reactors and Fischer–Tropsch*," by S.C. Saxena, Catal. Rev.—Sci. Eng., 37(2), pp. 227–309, 1995.

Article entitled: "*Gas holdup in slurry bubble columns: effect of column diameter and slurry concentrations*," by Rajamani Krishna et al., AIChE. Journal, vol. 43, No. 2, pp. 311–316, Feb. 1997.

Article entitled: "*Fundamentals and selection of advanced Fischer–Tropsch reactors*," by S.T. Sie et al., Elsevier, Applied Catalyst A: General 186, pp. 55–70, 1999.

Article entitled: "*Dynamic simulation of bubbly flow in bubble columns*," by Y. Pan et al., Pergamon, Chemical Engineering Science 54, pp. 2481–2489, 1999.

Article entitled: "*Numerical simulation of gas–liquid dynamics in cylindrical bubble column reactors*," by Jayanta Sanyal et al., Pergamon, Chemical Engineering Science 54, pp. 5071–5083, 1999.

Article entitled: "*Gas holdup and mass transfer in bubble column reactors operated at elevated pressure*," by H.M. Letzel et al., Pergamon, Chemical Engineering Science 54, pp. 2237–2246, 1999.

Article entitled: "*Hydrodynamic simulation of methanol synthesis in gas–liquid slurry bubble column reactors*," by Yuanxiang Wu et al., Pergamon, Chemical Engineering Science 55, pp. 573–587, 2000.

S. C. Saxena et al., *Mathematical Modeling of Fischer–Tropsch Slurry Bubble Column Reactors*, Chem. Eng. Con. vol. 40 (1986) pp. 97–151.

D. Bukur et al., *Gas Holdup and Solids Dispersion in a Three Phase Slurry Bubble Column*, AlChE J. 36, 1990, pp. 1731–1735.

P.M. Calderbank et al., *The Continuous Phase Heat and Mass–Transfer Properties of Dispersions*, Chem. Eng. Sci. 16, 1961, p. 39.

Y. Kato et al., *The Behavior of Suspended Solid Particles and Liquid Bubble Columns*, J. Chem. Eng. Japan 5, 1972, p. 112.

W. D. Becker, *Hydrodynamic Properties of the Fischer–Tropsch Slurry Process*; Ind. Eng. Chem. Process Des. Dev. 19, 1980, pp. 699–708.

D. Schanke et al., *Optimization of Fischer–Tropsch Reactor Design and Operations in GTL Plants*; Natural gas conversion VI; proceedings of the 6$^{th}$ Natural Gas Conversion Symposium, Jun. 17–22, 2001, Alaska USA; in Studies in Surface Science and Catalysis, 136, 2001, p. 239.

R. Krishna, *A Scale–up Strategy for a Commercial Scale Bubble Column Slurry Reactor for Fischer–Tropsch Synthesis*, Oil and Gas Science and Technology–Rev. 55, 2000, pp. 359–393.

G. van der Laan et al., *Multicomponent Reaction Engineering Model for Fe–Catalized FT Synthesis in Commercial Scale Slurry Bubble Column Reactors*, Chem. Eng. Science 54, 1999, pp. 5013–5019.

R. Krishna et al., *Design and Scale–Up of the FT Bubble Column Slurry Reactor*, Fuel Processing Technology 64, 20000, pp. 73–105.

* cited by examiner

*Primary Examiner*—J. Parsa
(74) *Attorney, Agent, or Firm*—Conley Rose P.C.

(57) ABSTRACT

A gas-agitated multiphase reactor system for the synthesis of hydrocarbons gives high catalyst productivity and reactor capacity. The system includes operating a multi-phase reactor in the well-mixed gas flow regime, with a Peclet number less than 0.175 and a single pass conversion ranging from 35% to 75%, wherein the inlet superficial gas velocity decreases with the decreasing of the reactor aspect ratio, and is preferably at least 20 cm/sec.

19 Claims, 6 Drawing Sheets

SLURRY BUBBLE REACTOR OPERATED IN WELL-MIXED GAS FLOW REGIME

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates to a process for the preparation of hydrocarbons from synthesis gas, i.e., a mixture of carbon monoxide and hydrogen, typically labeled the Fischer-Tropsch process. More particularly, this invention relates to slurry bubble reactors that can maximize the production rate and/or reduce the reactor volume in a Fischer-Tropsch process. Still more particularly, this invention relates a method that provide the optimum design and operation of slurry bubble reactors that can maximize the production rate and/or reduce the reactor volume in a Fischer-Tropsch process.

BACKGROUND

Large quantities of methane, the main component of natural gas, are available in many areas of the world, and natural gas is predicted to outlast oil reserves by a significant margin. However, most natural gas is situated in areas that are geographically remote from population and industrial centers. The costs of compression, transportation, and storage make its use economically unattractive. To improve the economics of natural gas use, much research has focused on the use of methane as a starting material for the production of higher hydrocarbons and hydrocarbon liquids, which are more easily transported and thus more economical. The conversion of methane to hydrocarbons is typically carried out in two steps. In the first step, methane is converted into a mixture of carbon monoxide and hydrogen (i.e., synthesis gas or syngas). In a second step, the syngas is converted into hydrocarbons.

This second step, the preparation of hydrocarbons from synthesis gas, is well known in the art and is usually referred to as Fischer-Tropsch synthesis, the Fischer-Tropsch process, or Fischer-Tropsch reaction(s). Fischer-Tropsch synthesis generally entails contacting a stream of synthesis gas with a catalyst under temperature and pressure conditions that allow the synthesis gas to react and form hydrocarbons.

More specifically, the Fischer-Tropsch reaction is the catalytic hydrogenation of carbon monoxide to produce any of a variety of products ranging from methane to higher alkanes and aliphatic alcohols. Research continues on the development of more efficient Fischer-Tropsch catalyst systems and reaction systems that increase the selectivity for high-value hydrocarbons in the Fischer-Tropsch product stream.

Originally, the Fischer-Tropsch synthesis was carried out in packed bed reactors. These reactors have several drawbacks, such as temperature control, that can be overcome by gas-agitated slurry reactors or slurry bubble column reactors. Gas-agitated multiphase reactors sometimes called "slurry reactors" or "slurry bubble columns," operate by suspending catalytic particles in liquid and feeding gas reactants into the bottom of the reactor through a gas distributor, which produces small gas bubbles. As the gas bubbles rise through the reactor, the reactants are absorbed into the liquid and diffuse to the catalyst where, depending on the catalyst system, they are typically converted to gaseous and liquid products. The gaseous products formed enter the gas bubbles and are collected at the top of the reactor. Liquid products are recovered from the suspending liquid by using different techniques like filtration, settling, hydrocyclones, magnetic techniques, etc. Gas-agitated multiphase reactors or slurry bubble column reactors (SBCRs) inherently have very high heat transfer rates; therefore, reduced reactor cost and the ability to remove and add catalyst online are principal advantages of such reactors in Fischer-Tropsch synthesis, which is exothermic. Sie and Krishna (Appl. Catalysis A: General 1999, 186, p. 55) give a history of the development of various Fischer Tropsch reactors and the advantages of slurry bubble columns over fixed bed reactors.

It is clear from the prior art that the performance of a SBCR is a combined result of reaction kinetics, heat and mass transfer, and multiphase hydrodynamics. Jackson, Torczynski, Shollenberger, O'Hern, and Adkins (Proc. Annual Int. Pittsburgh Coal Conf. 1996, 13$^{th}$ (Vol 2), p. 1226) showed experimental evidence of the increase of gas hold up with increase in the inlet superficial velocity in a SBCR for Fischer Tropsch synthesis. Krishna, DeSwart, Ellenberger, Martina, and Maretto (AIChE J. 1997, 43(2), p. 311) measured experimentally the increase in gas holdup with an increase in the gas velocity and solids concentration in a slurry bubble column in chum turbulent regime. Letzel, Schouten, Krishna and van den Bleek (Chem. Eng. Sci 1999, 54, p. 2237) developed a simple model for gas holdup and mass transfer at high pressure in a slurry bubble column. Numerically, Sanyel, Vasquez, Roy, and Dudukovic (Chem. Eng. Sci. 1999, 54, p. 5071) and Pan, Dudukovic, and Chang (Chem. Eng. Sci. 1999, 54, p. 2481) showed examples of computational fluid dynamic modeling and optimization of a slurry bubble column reactor irrespective of the chemistry. Wu and Gidaspow, (Chem. Eng. Sci 2000, 55, p. 573) show examples of computational fluid dynamics simulations of hydrodynamics of Slurry Bubble Column processes.

Much previous work has been aimed at optimization of the slurry bubble column system for Fischer Tropsch and other chemistries. Stem et al. (*Ind. Eng. Chem. Process Des. Dev.* 1985, 25, p. 1214) developed an axial dispersion model for describing the performance of gas agitated multiphase reactor used for Fischer-Tropsch synthesis. Saxena (Cat. Rev. -Sci. Eng. 1995 37, p. 227) gives a review of the detailed experimental findings and theoretical models for the design of a Fischer Tropsch SBCR. It is clear from all the work in industry and academia that there is a need for an optimized Fischer Tropsch reactor and reactor configuration.

Considerable patent literature addresses the optimization of the Fischer Tropsch Slurry Bubble Column reactor (SBCR) and the overall system. U.S. Pat. No. 5,252,613 presents a method for improving catalyst particle distribution by introducing a secondary suspending fluid. U.S. Pat. No. 5,348,982 shows an optimal mode of operation for SBCR. U.S. Pat. No. 5,382,748 shows the use of a vertical downcomer to promote the uniform catalyst distribution. U.S. Pat. Nos. 5,961,933 and 6,060,524 show that optimal operation can be obtained by introduction of liquid recirculation.

The flow patterns of individual phases will affect the reactor performance. The plug flow and well-mixed flow are two extreme flow patterns for reactor systems. The dimensionless number, Pe, can be used to represent the degree of backmixing in plug flow. It is noted by Deckwer (Chem. Eng. Sci. 1976, 31, p. 39) that the gas dispersion is important in bubble columns of diameters greater than 0.5 m as it may have a strong influence on conversion. It is found that the gas dispersion is a function of the gas holdup, superficial gas velocity, and reactor diameter. In the gas-liquid-solid three phase reactor, the gas holdup depends on many factors such as gas and liquid velocities, gas distributor design, column geometry, physical properties of the gas and liquid, particle concentration, and reactor internals. Therefore, the gas dispersion coefficient is also a complicated function of these design and operating parameters. Usually, it is necessary to perform an in situ measurement to determine the dispersion coefficient at a given condition.

U.S. Pat. No. 5,348,982 described the plug flow to be the preferred optimum operating condition for the Slurry Bubble Column reactor in Fischer-Tropsch synthesis. The '982 patent teaches that the gas velocity should be larger than 0.2 $D_G/H$, which corresponds to the gas Peclet number larger than 0.2. The concept taught in the '982 patent is that the reactor volume required to achieve a high conversion using plug flow is significantly less than the volume required using well mixed flow. It is clear that the plug flow favors the high conversion for the FT synthesis. However, the extent of the backmixing is a function of the mechanical energy imported into the system. To maintain a plug flow for achieving the high conversion requires the use of a lower gas input into the reactor, which in turn reduces the reactor productivity significantly.

It is believed that a significant improvement of the optimization of the SBCR for the Fischer-Tropsch synthesis is achievable using the concepts disclosed herein.

The flow pattern of the gas phase in the reactor can be described by the gas Peclet number, which has the form $PeG=U_GL/DG$, where $U_G$ is the superficial gas velocity, L is the expanded slurry bed height, and DG is the dispersion coefficient. The dispersion coefficient is a function of the superficial gas velocity, gas holdup, and the reactor diameter. The gas Peclet number increases with the increase of gas velocity and the reactor aspect ratio, L/D. The change of the gas Peclet number with the superficial gas velocity at three reactor aspect ratios is shown in FIG. 1. As shown in FIG. 1, for a given reactor aspect ratio, the gas Peclet number decreases with the increase of the superficial gas velocity. If the reactor has a small aspect ratio, the gas phase will be in the well-mixed flow at most of the commercial gas flow rate. For a large aspect ratio reactor, the gas phase will be in the well-mixed regime at high gas velocity while in the plug flow regime at low gas velocity. The superficial gas velocity required to achieve the well-mixed gas flow decreases with the decreasing of reactor aspect ratio.

SUMMARY OF THE INVENTION

A preferred embodiment of the present invention provides a method for the synthesis of hydrocarbons using cobalt catalysts in a three-phase reactor that gives high catalyst productivity and reactor capacity. The method defines the optimum design and operation of the three-phase reactor to be in the well-mixed gas flow regime, with a gas Peclet number, calculated as described above, less than 0.175 and a single pass conversion ranging from 35% to 75%, wherein the inlet superficial gas velocity decreases with the decreasing of the reactor aspect ratio, and is preferably at least 20 cm/sec. Inlet superficial gas velocity is defined herein as the superficial gas velocity using the inlet reactor conditions, that is, the total gas volumetric flow rate at reactor inlet temperature and pressure divided by the cross sectional area of the reactor vessel, excluding the area occupied by any internals. In accordance with the preferred embodiments, the present reactor system comprises at least one stage with recycle or multiple stages with or without recycle, wherein the inlet gas superficial velocity is at least 20 cm/sec, and overall syngas conversion is at least 90%, while syngas per stage conversion in each reactor ranges from 35% to 75%.

It is illustrated in the present invention that high catalyst productivity and reactor capacity can be achieved by operating at a high gas input and an intermediate single pass conversion. At a high gas input, the gas phase will be in well-mixed flow regime. However, at the intermediate conversion range, say conversion from 35% to 75%, the reactor volume required for the well-mixed gas flow is close to that for the plug flow regime. There are many advantages of choosing the well-mixed gas regime for the FT synthesis as shown in the current invention.

The present invention provides a gas-agitated multiphase reactor system that is effective for enabling maximum reactor productivity and/or minimizing reactor volume.

BRIEF DESCRIPTION OF THE DRAWINGS

For a detailed description of the preferred embodiments of the present invention, reference will now be made to the accompanying Figures, wherein.

DETAILED DESCRIPTION OF A PREFERRED EMBODIMENT

It has been discovered that, in a gas-agitated slurry reactor or slurry bubble column reactor, a maximum reactor productivity or a minimum reactor volume can be achieved by operating a multi-phase reactor to be in the well-mixed gas flow regime, with a gas Peclet number less than 0.175 and a single pass conversion ranging from 35% to 75%, wherein the inlet superficial gas velocity decreases with the decreasing of the reactor aspect ratio, and is preferably at least 20 cm/sec. Unreacted gas can be either fed to another reactor or be recycled back to mix with the inlet gas stream.

The preferred embodiment of the present invention is the Fischer-Tropsch synthesis of hydrocarbon using supported or precipitated cobalt catalysts. The catalysts may contain additional promoters comprising Group I, II, V, or VII metals. The catalyst contains about 1% to 100% cobalt. Cobalt catalysts have a high activity and selectivity for the Fischer-Tropsch synthesis. The kinetic expression given by Yates and Satterfield (Energy and Fuels, (1991) 5, 168–173) can be used to evaluate the performance of slurry bed reactor using Cobalt catalysts when combined with the hydrodynamics and mass transfer predictions.

Figure 1:
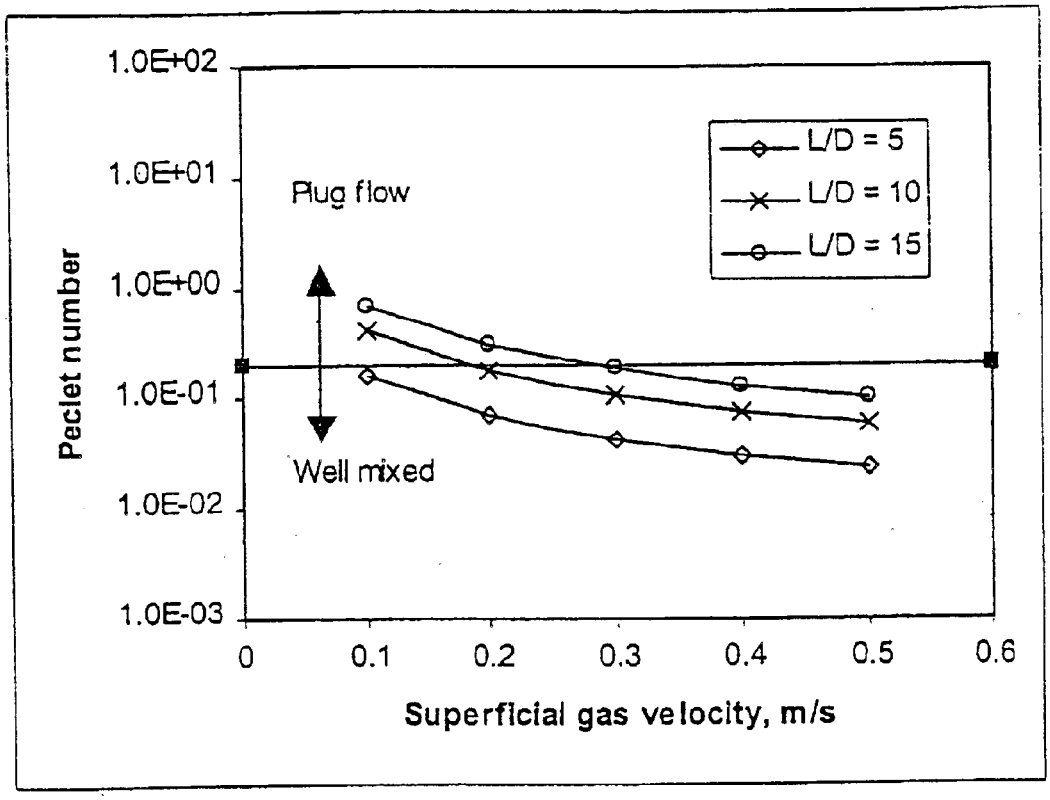
FIG. 1 is a plot illustrating the change in gas Peclet number with the superficial gas velocity at different reactor aspect ratios.
Figure 2:
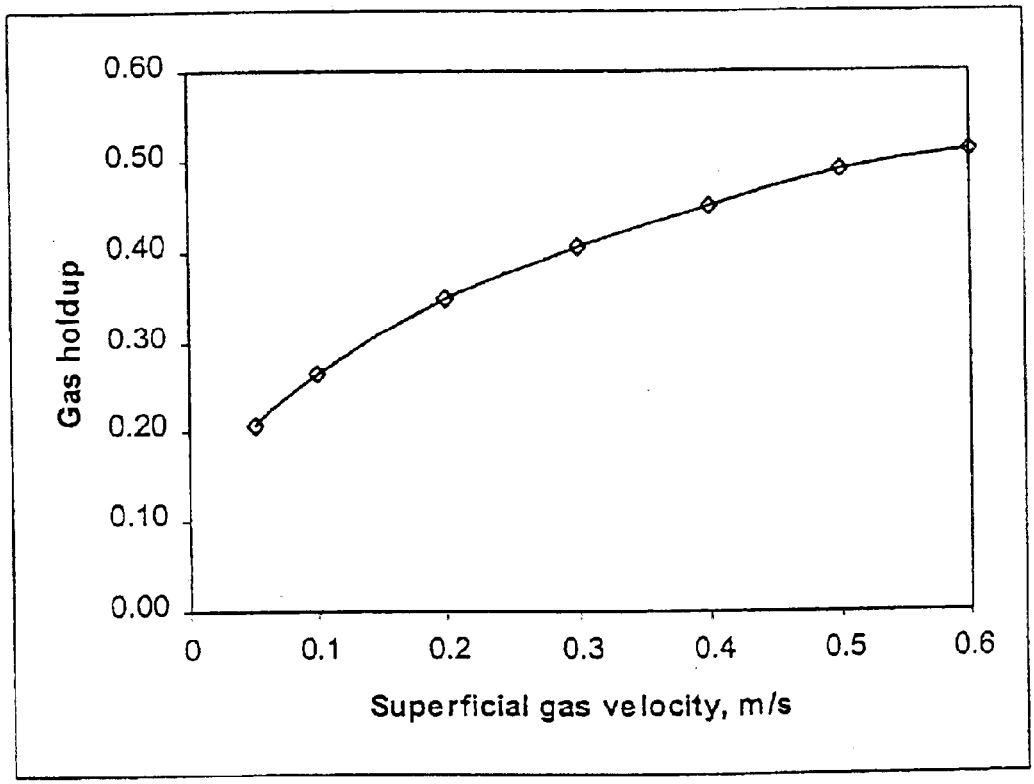
FIG. 2 is a plot illustrating increasing gas holdup with increasing of superficial gas velocity.
Figure 3:
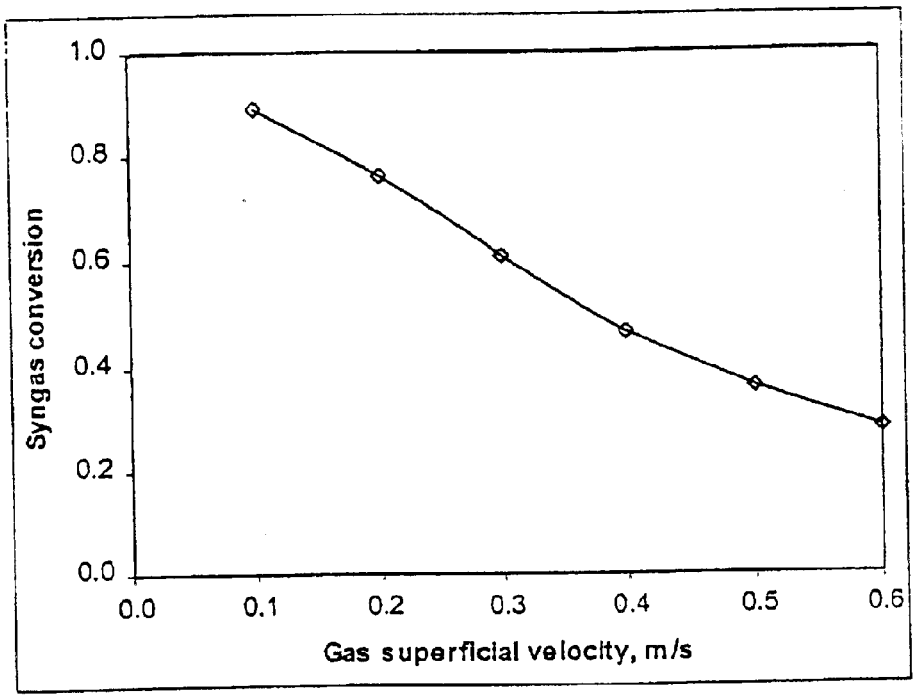
FIG. 3 is a plot illustrating decreasing syngas conversion with increasing of superficial gas velocity.

At a given reactor geometry and operating conditions, the productivity of a SBCR is related to the flow pattern as well as the catalyst activity. For a given catalyst, and therefore for a given activity, the reactor productivity changes with the gas flow rate at the reactor inlet. As illustrated in FIG. 2, a high gas flow rate corresponds to a high gas holdup in the reactor. Increased gas holdup tends to reduce the slurry volume and the gas residence time in the reactor. Therefore, the conversion of the reactor decreases with the increase in superficial inlet gas velocity, as shown in FIG. 3.

Figure 4:
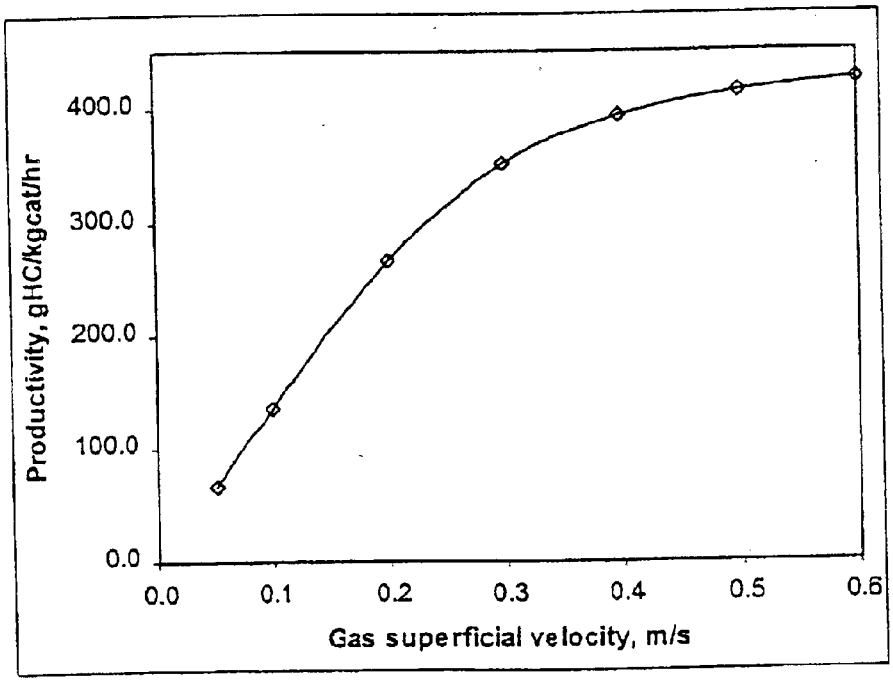
FIG. 4 is a plot illustrating increasing productivity with increasing of superficial gas velocity.
Figure 5:
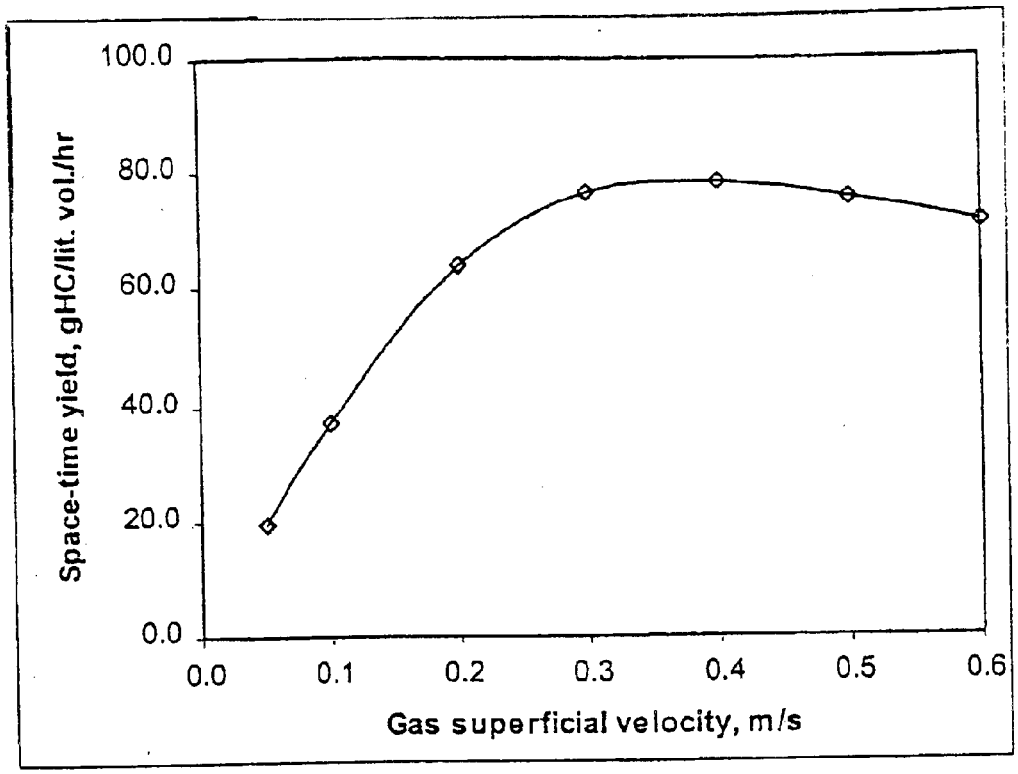
FIG. 5 is a plot illustrating increasing the change in space-time yield with increasing of superficial gas velocity.

On the other hand, a higher gas flow rate gives a higher mass transfer rate and a larger gas-liquid contact area, which each contribute to a high productivity, as shown in FIG. 4 for the catalyst productivity and FIG. 5 for the reactor space-time yield. An optimum solution can be found based on the facts that the conversion decreases and the catalyst productivity and space-time yield increase with the increase of inlet gas flow rate. Heretofore, the interaction between reactor variables and the way in which the overall reactor system is configured has not been understood.

Thus, for a practical application of the Fischer-Tropsch technology, the productivity of the reactors per unit volume is much higher at high gas superficial velocity. We have discovered that the objective therefore is not to operate under conditions conducive to high per pass conversion, but under conditions with a high productivity per reactor volume or per unit mass of catalyst. This high productivity region is linked to high gas superficial velocities, as shown in FIG. 4. The parameters associated with the gas superficial velocity, and by definition with the gas dispersion coefficient, are therefore critical for the successful application of the slurry bed reactor FT technology. As can be seen from FIGS. 4 and 5, the gain in volumetric productivity vs. linear velocity increases linearly up to about 20 cm/s. This gives a preferred lower limit with regard to the superficial gas velocity for the optimum operating and design of a slurry bed reactor for FT synthesis.

Figure 6:
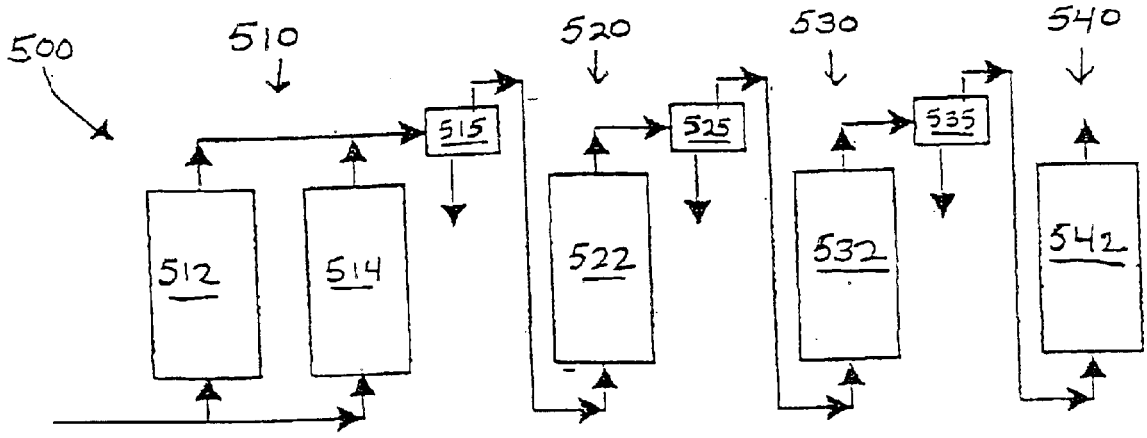
FIG. 6 is a schematic illustration of a preferred embodiment of the present invention.

Referring now to FIG. 6, a preferred embodiment of the invention includes a system 500 comprising a first stage of slurry reactors in parallel 510, a second stage of slurry reactors 520, a third stage of slurry reactors 530, and a fourth stage of slurry reactors 540, a condenser 515 between first stage 510 and second stage 520, a condenser 525 between second stage 520 and third stage 530, and a condenser 535 between the third stage 530 and fourth stage 540. First stage 510 preferably comprises two slurry reactors 512 and 514; second stage 520 preferably comprises one slurry reactor 522; and third stage 530 and fourth stage 540 each comprise preferably one slurry reactor 532 and 542 respectively. The syngas conversion is 52%, 40%, 42%, and 42% in the first, second, third, and fourth stages, respectively. The overall syngas conversion of this example is 90%. This is a non-restrictive example. As the per stage syngas conversion increases, the number of stages necessary to achieve an overall syngas conversion of at least 90% decreases. The process can also use just one reactor/stage with single pass conversion ranging from 35% to 75% and still achieve the overall conversion of more than 90%, preferably by using recycle.

Operation

According to one preferred embodiment, a slurry bed reactor operates at a gas Peclet number less than 0.175, more preferably less than 0.15, and still more preferably less than 0.12, with a single pass conversion from 35% to 75%, the superficial gas velocity greater than 20 cm/s, and the total conversion being larger than 90% with recycle. Alternatively, multiple stages of slurry bed reactors can be used, with each stage operating at a per pass conversion less than 75%, with or without recycle, and with a total conversion greater than 90%.

In a preferred mode of operation, the reactor in the preferred Fischer-Tropsch systems contain catalysts material and are charged with feed gases comprising hydrogen or a hydrogen source and carbon monoxide. $H_2$/CO mixtures suitable as a feedstock for conversion to hydrocarbons according to the process of this invention can be obtained from light hydrocarbons such as methane by means of steam reforming or partial oxidation. The hydrogen is preferably provided by free hydrogen, although some Fischer-Tropsch catalysts have sufficient water gas shift activity to convert some water to hydrogen for use in the Fischer-Tropsch process. It is preferred that the mole ratio of hydrogen to carbon monoxide in the feed be greater than 0.5:1 (e.g., from about 0.67:1 to 2.5:1). The feed gas may also contain carbon dioxide or other compounds that are inert under Fischer-Tropsch reaction conditions, including but not limited to nitrogen, argon, or light hydrocarbons. The feed gas stream should contain a low concentration of compounds or elements that have a deleterious effect on the catalyst. The feed gas may need to be treated to ensure low concentrations of sulfur or nitrogen compounds such as hydrogen sulfide, ammonia and carbonyl sulfides.

The feed gas is contacted with the catalyst in a reaction zone in each reactor. Mechanical arrangements of conventional design may be employed in the reaction zone. Also, water partial pressure should be kept to a minimum. The water partial pressure is calculated as the mole fraction of water in the reactor outlet gas multiplied by the total outlet pressure of the reactor in a particular stage.

The process is typically run in a continuous mode. In this mode, typically, the gas hourly space velocity through the reaction zone may range from about 50 volumes/hour/volume expanded catalyst bed (v/hr/v) to about 10,000 v/hr/v, preferably from about 300 v/hr/v to about 2,000 v/hr/v. The gas hourly space velocity is defined at the standard condition where the pressure is 1 bar and temperature is 0 degree centigrade. The reaction zone temperature is typically in the range from about 160° C. to about 300° C. Preferably, the reaction zone is operated at conversion promoting conditions at temperatures from about 190° C. to about 260° C. The reaction zone pressure is preferably in the range of from about 80 psig (653 kPa) to about 1000 psig (6994 kPa), more preferably from 80 psig (653 kPa) to about 600 psig (4237 kPa), and still more preferably, from about 140 psig (1066 kPa) to about 500 psig (3497 kPa).

The reaction products will have a large range of molecular weights. Catalysts are useful for making hydrocarbons having five or more carbon atoms, especially when the above-referenced space velocity, temperature and pressure ranges are employed.

The wide range of hydrocarbon species produced in the reaction zone will typically result in liquid phase products at the reaction zone operating conditions. Therefore, the effluent stream of the reaction zone will often be a mixed phase stream. The effluent stream of the reaction zone may be cooled and passed into a vapor-liquid separation zone to condense the light hydrocarbons and to condense and remove water. The vapor phase material may be passed into a second stage of cooling for recovery of additional hydrocarbons and removal of more water. The liquid phase material from the initial vapor-liquid separation zone together with any liquid from a subsequent separation zone may be fed into a fractionation column. Typically, a stripping column is employed first to remove light hydrocarbons such as propane and butane. The remaining hydrocarbons may be passed into a fractionation column wherein they are separated by boiling point range into products such as naphtha, kerosene and fuel oils. Hydrocarbons recovered from the reaction zone and having a boiling point above that of the desired products may be passed into conventional processing equipment such as a hydrocracking zone in order to reduce their molecular weight. The gas phase recovered from the reactor zone effluent stream after hydrocarbon recovery and water removal may be partially recycled if it contains a sufficient quantity of hydrogen and/or carbon monoxide.

EXAMPLES

The following theoretical examples illustrate how the present invention conversion rates comparable to current commercial slurry reactors for the Fischer-Tropsch process can be achieved at a lower cost by operating the system in the well-mixed gas flow regime, as indicated by a very low Peclet number, and thereby maximizing reactor productivity or minimizing reactor volume.

Example 1

High Catalyst Productivity and Space Time Yield at Low Gas Peclet Number (Thus, a Well-Mixed Gas Flow Regime)

Figure 7:
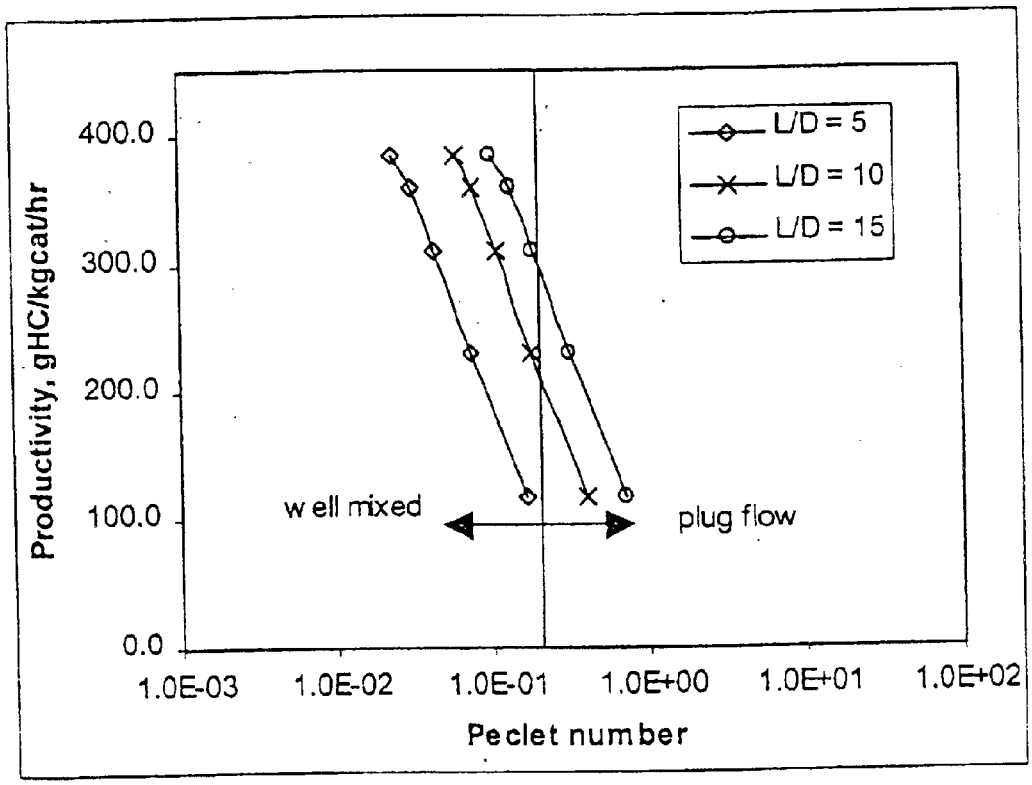
FIG. 7 is a plot illustrating the effect of the gas Peclet number on catalyst productivity at different aspect ratios.

FIG. 7 shows the effect of the Peclet number on catalyst productivity at different aspect ratios. It is shown that the productivity decreases with an increase in the gas Peclet number. The higher catalyst productivity requires less catalyst to achieve the certain conversion.

Figure 8:
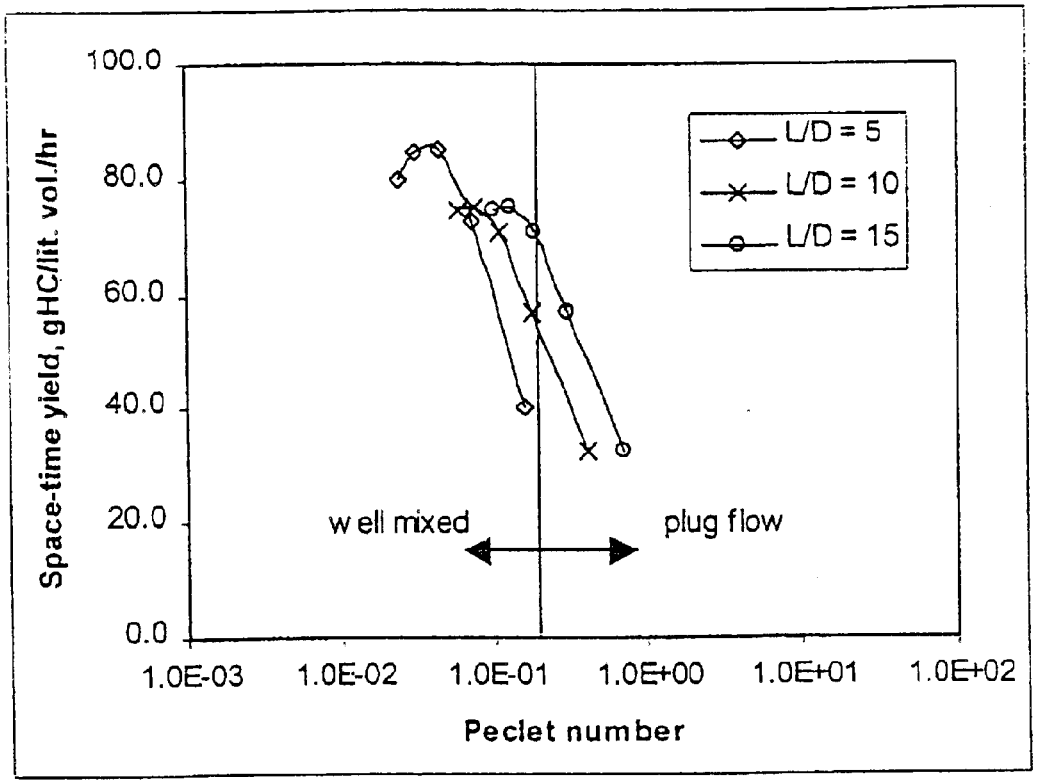
FIG. 8 is a plot illustrating the effect of the gas Peclet number on space time yield.

Similarly, as shown in FIG. 8, the space time yield decreases significantly with the increase of the Peclet number. It is also clear from FIG. 8 that a lower gas Peclet number is directly related to a lower reactor volume needed to achieve the same product yields.

Example 2

Intermediate Syngas Conversion in a Well-Mixed Gas Flow Regime

Figure 9:
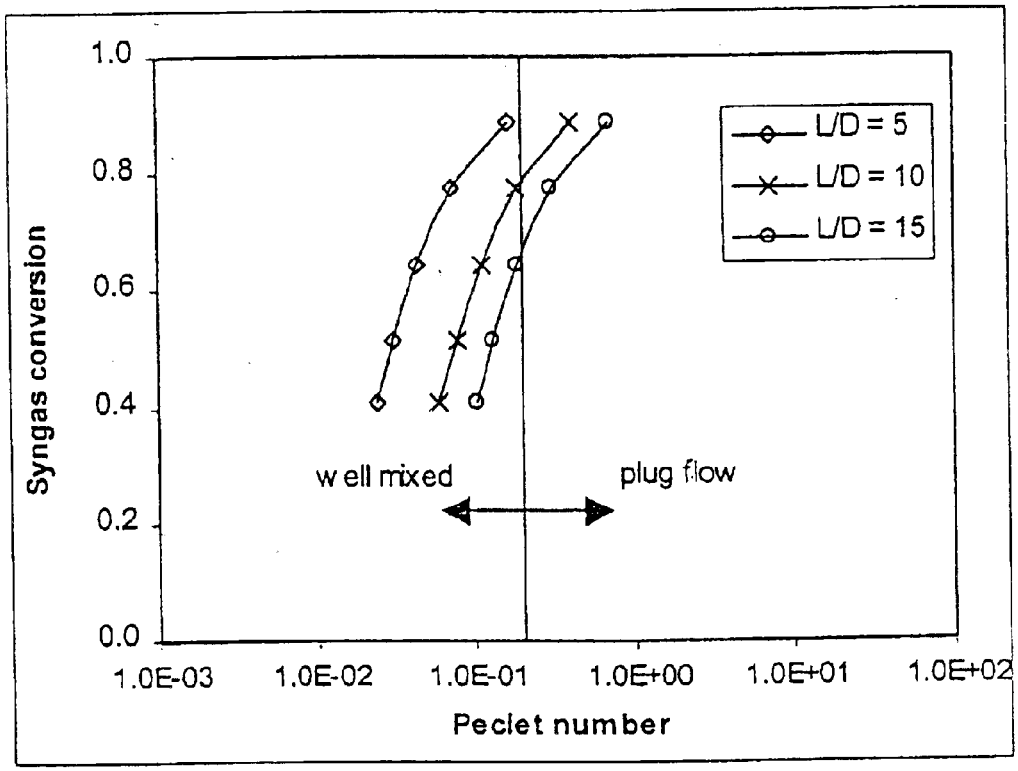
FIG. 9 is a plot illustrating the effect of the gas Peclet number on syngas conversion.

FIG. 9 illustrates the effect of the gas Peclet number on syngas conversion at different aspect ratios. Combining this analysis with the results of catalyst productivity and space time yield (FIGS. 7 and 8), we have found that an optimum design of the slurry bed reactor falls in the low Peclet number with the intermediate syngas conversion.

Example 3

Figure 10:
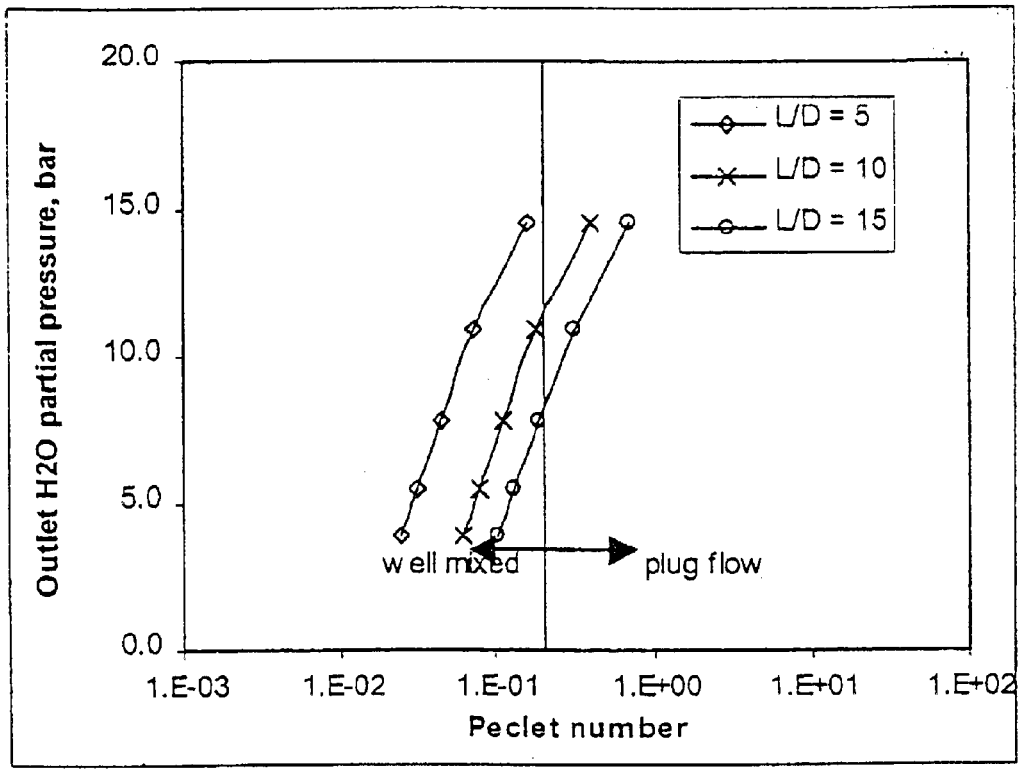
FIG. 10 is a plot illustrating the effect of the gas Peclet number on outlet $H_2O$ partial pressure.

Lower $H_2O$ Partial Pressure and Therefore Lower Catalyst Deactivation Rate As shown in FIG. 10, the outlet $H_2O$ partial pressure increases with an increase in the gas Peclet number. The high $H_2O$ partial pressure gives a high catalyst deactivation rate for most FT synthesis, which is undesirable. Hence, a FT slurry bed reactor at well-mixed gas flow gives a lower $H_2O$ partial pressure and therefore less catalyst deactivation rate and longer catalyst life.

Example 4

Figure 11:
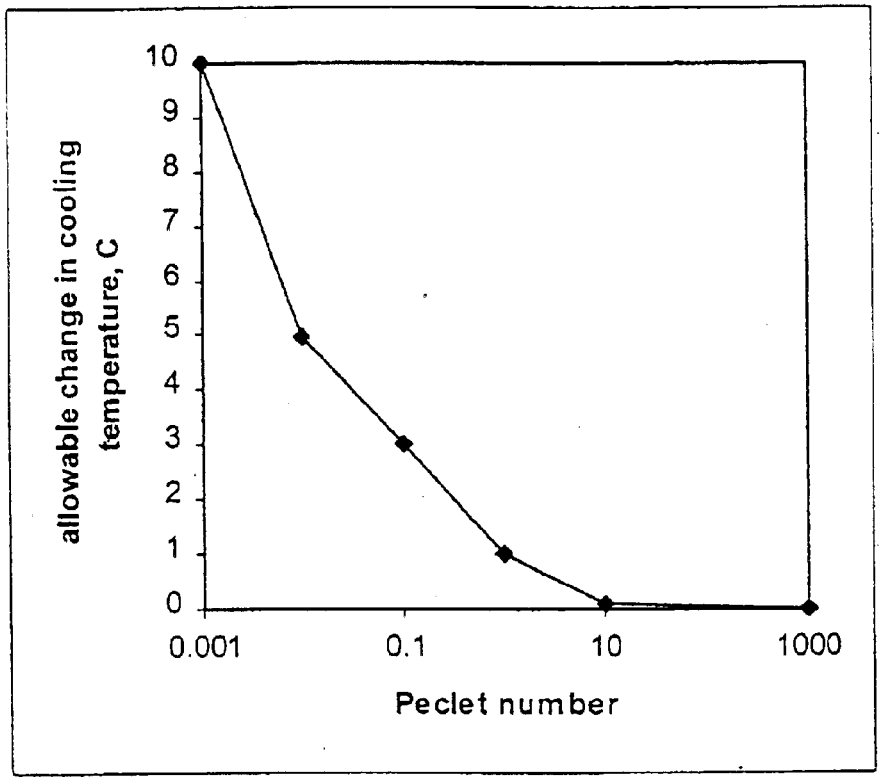
FIG. 11 is a plot illustrating the effect of the gas Peclet number on the allowable change of cooling temperature.

Improved Temperature Control, Relatively Larger Range of Operating Window with Respect to Temperature The Fischer-Tropsch synthesis is a highly exothermic reaction. Meanwhile, the catalyst activity and deactivation rate are sensitive to the reaction temperature. When the temperature is larger than 250° C., significant catalyst deactivation occurs. On the other hand, at a temperature lower than 200° C., the catalyst activity is low. It is found that a small change in cooling temperature can lead to a significant temperature variation in the reactor if the reactor is operated in the plug flow regime. In contrast, the change in cooling temperature leads to a smaller temperature variation in the reactor if the reactor is operated in the well-mixed flow regime. Assuming, for purposes of illustration, that the maximum allowable temperature variation in the reactor is 20° C., so as to keep the catalyst from higher deactivation rate at higher temperature or lower activity at lower temperature, the allowable change in cooling temperature decreases with the increase of the Peclet number, as shown in FIG. 11. Only very small changes in the cooling temperature (0.1 to 1° C.) are allowable in the plug flow regime, which makes the heat transfer equipment difficult to design.

What is claimed is:

1. A method for producing hydrocarbons from syngas in a three-phase catalytic system in which the catalyst comprises solid particles, comprising:

(a) providing a reactor containing the catalyst;

(b) feeding the syngas into the reactor so as to generate a liquid product;

(c) operating the three-phase system in a well-mixed gas flow regime, with a gas Peclet number less than 0.175; and (d) removing hydrocarbons from the reactor.

2. The method according to claim 1 wherein the inlet superficial gas velocity is at least 20 cm/sec.

3. The method according to claim 1 wherein the reactor includes a recycle line.

4. The method according to claim 1 wherein the process comprises multiple stages and in which each stage may have one or more reactors, and wherein the inlet gas superficial velocity is at least 20 cm/sec and syngas per pass conversion in each reactor is between 35% and 75%.

5. The method according to claim 4 wherein the overall syngas conversion is at least 90%.

6. The method according to claim 1 wherein the mole ratio of hydrogen to carbon monoxide in the syngas is between about 0.67:1 and about 2.5:1.

7. The method according to claim 1 wherein the hydrocarbons in step (d) comprise $C_1$ to $C_{80+}$ hydrocarbons.

8. The method according to claim 1 wherein the catalyst comprises a supported or precipitated cobalt catalyst.

9. A method for operating a Fischer-Tropsch reactor system containing solid catalyst, gaseous feed, and gas and liquid products, comprising maintaining the rates of gaseous feed and liquid withdrawal such that the reactor system is maintained in a well-mixed gas flow regime described by $$U_G \leqq 0.175 D_G/L,$$

where $U_G$ is the inlet superficial gas velocity, L is the expanded slurry bed height, and $D_G$ is the dispersion coefficient.

10. The method according to claim 9 wherein the inlet superficial gas velocity is at least 20 cm/sec.

11. The method according to claim 9 wherein the expanded slurry bed height is at least 60% of the total reactor height.

12. The method according to claim 9 wherein the process comprises multiple stages and in which each stage may have one or more reactors, and wherein the inlet gas superficial velocity is at least 20 cm/sec and syngas per pass conversion in each reactor is between 35% and 75%.

13. The method according to claim 12 wherein the overall syngas conversion is at least 90%.

14. The method according to claim 9 wherein the mole ratio of hydrogen to carbon monoxide in the syngas is greater than 0.5:1.

15. The method according to claim 9 wherein the mole ratio of hydrogen to carbon monoxide in the syngas is between about 0.67:1 and about 2.5:1.

16. The method according to claim 9 wherein the Fischer-Tropsch reactor system produces hydrocarbons comprising $C_1$ to $C_{80+}$ hydrocarbons.

17. The method according to claim 9 wherein the catalyst comprises a supported or precipitated cobalt catalyst.

18. The method according to claim 1 wherein the volume productivity of the catalytic system is at least 350 gHC/kg.cat/hr.

19. The method according to claim 9 wherein the volume productivity of the catalytic system is at least 350 gHC/kg.cat/hr.

* * * * *